US005791828A

United States Patent [19]

Fergusson

[11] Patent Number: 5,791,828

[45] Date of Patent: Aug. 11, 1998

[54] PLATE FOR USE IN SUPPORT OF A MINE ROOF

[76] Inventor: Jeffrey Robert Fergusson, 78 Cairnes Rd., Glenorie, Australia, 2157

[21] Appl. No.: 589,839

[22] Filed: Jan. 22, 1996

[30] Foreign Application Priority Data

Feb. 9, 1995 [AU] Australia ..... PN0977

[51] Int. Cl.[6] ..... E21D 21/00; F16B 43/00

[52] U.S. Cl. ..... 405/302.1; 405/259.1; 411/531; 411/545

[58] Field of Search ..... 405/302.1, 288, 405/255.1; 403/274, 277, 282; 52/410, 408, 703; 411/531, 545, 533; D8/397, 399

[56] References Cited

U.S. PATENT DOCUMENTS

| | | | |
|---|---|---|---|
| 3,090,203 | 5/1963 | Durget | 405/302.1 X |
| 3,133,468 | 5/1964 | Cumming | 405/302.1 |
| 4,652,178 | 3/1987 | Kates et al. | 405/302.1 |
| 4,708,559 | 11/1987 | Locotos | 405/259.1 X |
| 5,292,209 | 3/1994 | Calandra, Jr. et al. | 405/302.1 |
| 5,385,433 | 1/1995 | Calandra, Jr. et al. | 405/302.1 |
| 5,628,587 | 5/1997 | Lesslie | 405/302.1 |

*Primary Examiner*—Tamara L. Graysay
*Assistant Examiner*—Frederick L. Lagman
*Attorney, Agent, or Firm*—Darby & Darby

[57] ABSTRACT

A plate (1) for use in support of a mine roof comprising two interconnected parts (2, 3). The first part has a substantially frusto-conical projecting portion (6) which defines a first opening (7) and the second part (3) is fitted to the first part and has all associated second opening to allow for a rock bolt to pass through the plate. The two parts (2, 3) are interconnected by an interconnecting portion (20) of the second part, which is arranged through the opening (7) and is deformed such as by being swaged over to capture the projecting portion 6. The interconnecting portion is swaged over to form either a single continuous return portion (13) or individual return portions (23).

5 Claims, 3 Drawing Sheets

PLATE FOR USE IN SUPPORT OF A MINE ROOF

The following invention relates to a plate for use in support of a mine roof.

One system for supporting a mine roof consists of securing plates to a rock face of the roof by means of a rock bolt, which is anchored in the rock face. The plates are tensioned against the rock face by a fastening nut threadably mounted on the bolt. Alternatively, the bolt is driven into the rock face until the head of the bolt itself tensions the plate against the rock face. Two plates are generally used for each bolt—a first plate known as a 'strata' plate and a second plate known as a "load" plate. The function of the load plate is to transfer the weight load of the rock face supported by the plates to the bolt. The load plate must have sufficient strength to support considerable loads, for example, up to 10 tonne. To increase the load bearing capacity of the load plate, the central portion may have a domed configuration. The strata plate is, in use, secured between the load plate and the mine roof. The strata plate is generally formed of lower gauge steel than the load plate so that it can conform to some degree to the rock face of the mine roof, to thereby inhibit fretting of the rock face about the bolt. It is known to weld the two plates together for ease of handling but the welding limits the degree to which the strata plate can conform to the rock face and the process of welding itself produces sites on both plates which are prone to corrosion.

In accordance with the present invention there is provided a plate for use in support of a mine roof comprising a first part for abutment with a rock face and a second part for transferring load from the first part to a rock bolt, the first part having a projecting portion which defines a first opening, and the second part being fitted to the first part and having an associated second opening to allow for the rock bolt to pass through the plate, wherein the second part includes an interconnecting portion which extends through the First opening and is deformed to interconnect the two parts.

Preferably the interconnecting portion includes at least one return portion extending from a lip defining the second opening.

Preferably the projecting portion is substantially frustoconical and the second part is domed to provide a recess for receipt of the projecting portion, the return portion or portions capturing the projecting portion in the recess by being swaged toward the internal surface of the projecting portion.

The invention is more fully described, by way of non-limiting example only, with reference to the accompanying drawings in which.

Figure 1:
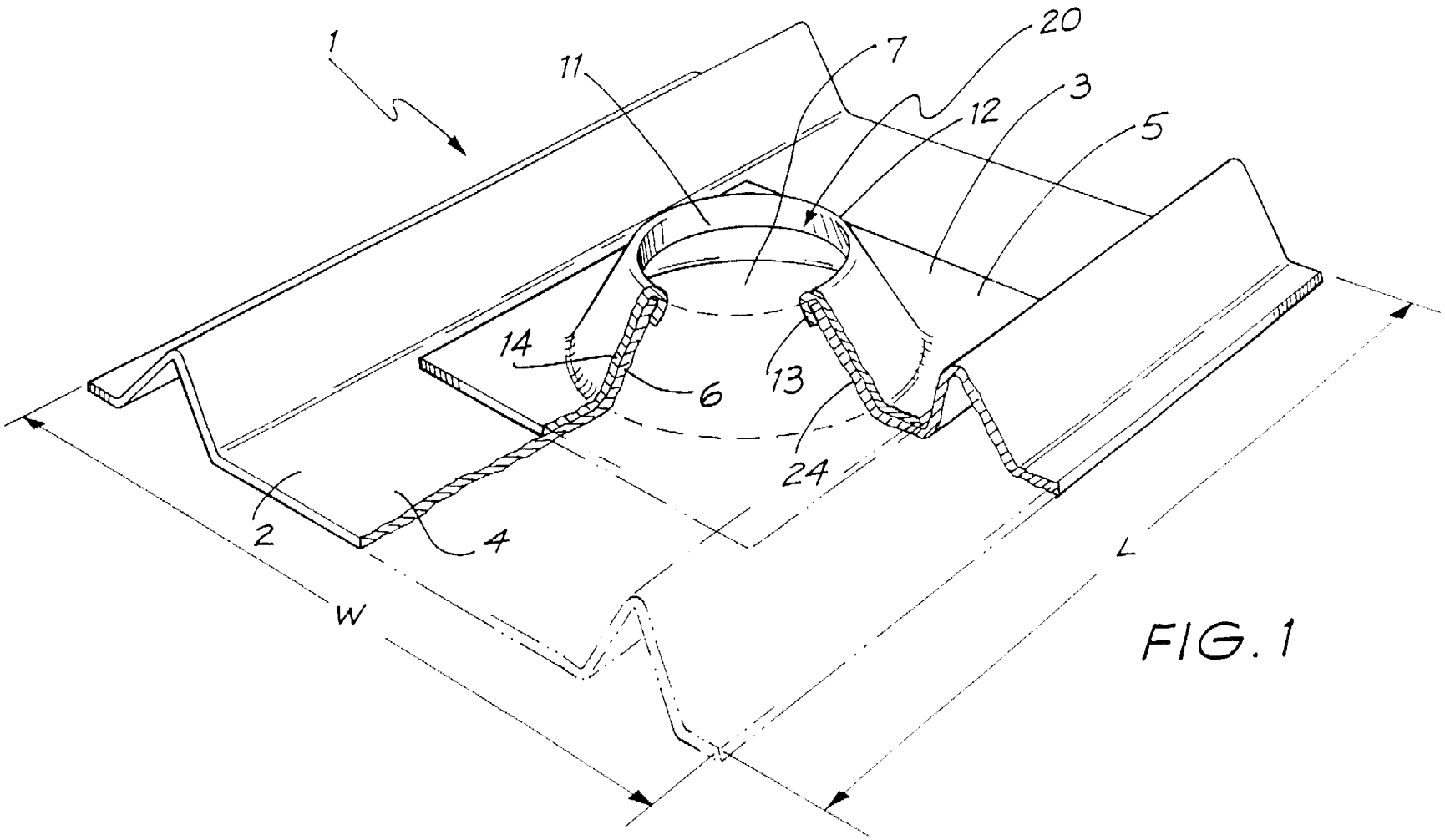
FIG. 1 is a perspective view showing a partial section of a plate formed in accordance with the present invention.

Referring firstly to FIG. 1 a plate 1 is shown which comprises two component parts 2, 3 in the form of strata plate 4 and a load plate 5. The strata plate 4 has a frustoconically shaped projecting portion 6 which defines an opening 7 for receipt of a rock bolt. The load plate 5 has a domed central portion 10 having a centrally disposed opening 11 defined by lip 12 and an interconnecting portion 20 which includes a return portion 13.

The plates 4 and 5 are interconnected by inserting the projecting portion 6 of the strata plate 2 into recessed region 14 formed by the domed portion 10 of the load plate 3 such that the return portion 13 extends through the opening 7 formed in the strata plate. The return portion is then deformed, preferably by being swaged over the projecting portion 6, toward the inner surface 24 of the strata plate 4, to thereby interconnect the two plates 4, 5 by capturing the projecting portion 6 between the return portion 13 and the inner wall 25 of the load plate 5.

Figure 2:
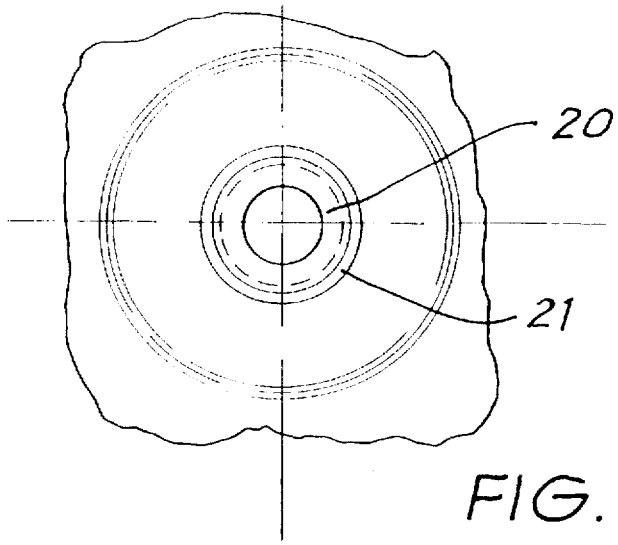
FIG. 2 is a view of the underside of a central portion of the plate, illustrated in FIG. 1.
Figure 3:
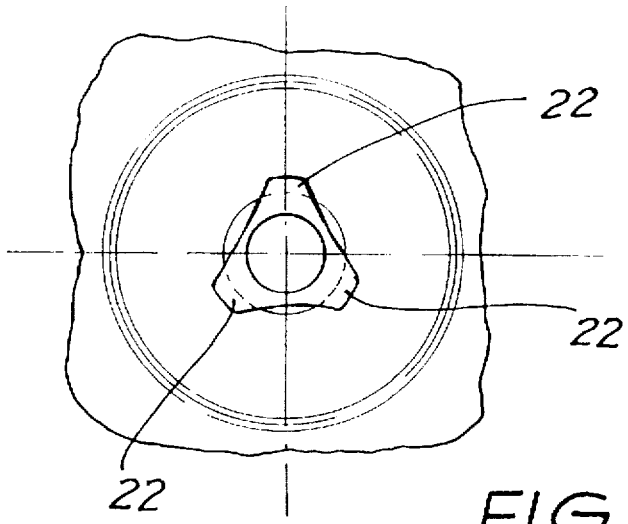
FIG. 3 is a view similar to that shown in FIG. 2, illustrating an alternative form of construction.
Figure 4:
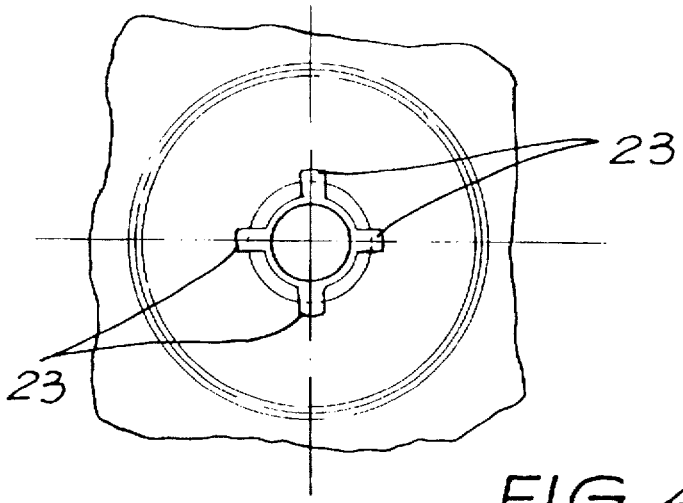
FIG. 4 is a view similar to that shown in FIG. 2, illustrating another alternative form of construction.

The interconnecting portion may be swaged over about its entire periphery 21, such that the return portion 13 is continuous, in the manner shown in FIG. 2 or, alternatively, the swaging may be made only at limited locations 22 about the periphery, such as represented in FIG. 3, so as to provide a number of separated return portions. In yet another alternative, the interconnecting portion may be formed of a number of discrete tab like formations 23, as shown in FIG. 4. In either case, the return portions need not be in clamping engagement with the inner surface 24 of the projecting portion, as long as the projecting portion is suitably captured between the return portion or portions and the inner wall 25 of the load plate 5, thereby allowing for some limited relative movement between the plates 4 and 5.

The strata plate preferably has a width W in the order of 280 millimetres, a length L in the order of 300 mm to 400 mm and a thickness of approximately 1.9 millimetres. The load plate preferably has a length and width in the order of 125 mm to 150 mm and a thickness in the order of 6 mm. The height of the domed portion 10 is preferably 20 mm and the diameter of the opening 11 is preferably in the order of 40 mm to 50 mm, but can vary depending upon the diameter of the bolt that passes through the opening. Both the strata plate 2 and the load plate 3 are preferably formed of steel.

Figure 5:
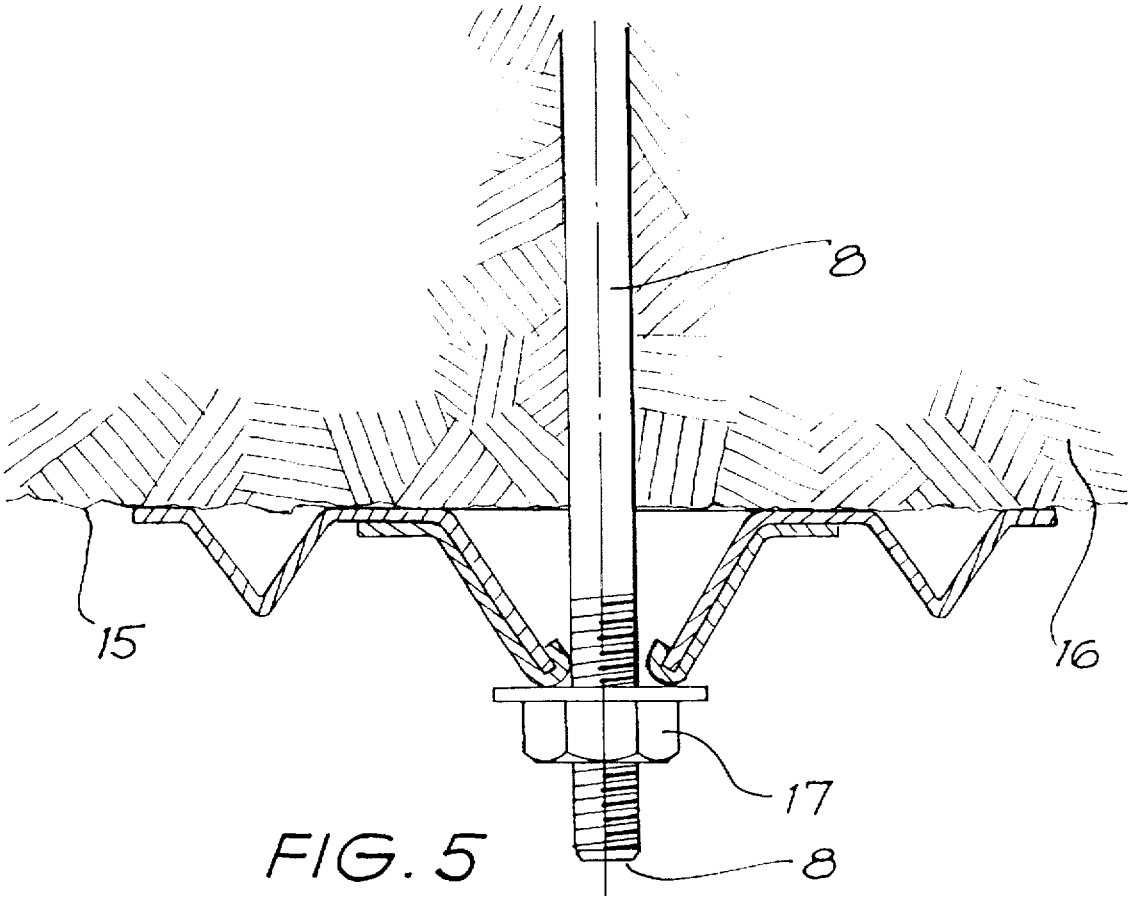
FIG. 5 is a cross-sectional view of the plate of FIG. 1 secured to a rock face.

As will be appreciated, the load plate 5 may be readily moulded or stamped, with the interconnecting portion formed so as to include either a single continuous return portion or discrete tabs, thereby allowing for the plate 1 to be easily and quickly assembled without the need for, or disadvantages associated with, welding, as described above. The unitary nature of the interconnected plates 4, 5 also allows the plate 1 to be easily handled so as to be readily held or driven into a working location against a rock face 15 of a mine roof 16, as shown in FIG. 5, and secured in place by, for example, a tensioning nut 17 threadably mounted on bolt 8.

The abovedescribed plate has been advanced merely by way of explanation and many modifications and variations may be made thereto without departing from the spirit and scope of the invention which includes every novel feature and combination of novel features defined in the following claims.

The claims defining the invention are as follows:

1. A plate for use in support of a mine roof, said plate comprising a first part for abutment with a rock face and a second part for transferring load from the first part to a rock bolt passing inside the first part, the first part having a projecting portion with an edge defining a first opening and an inside surface, and the second part being fitted outside of the first part and having an associated second opening to allow for the rock bolt to pass through the plate, wherein the second part includes an interconnecting portion which extends through the first opening and is deformed around said edge to contact at least a portion of the inside surface of said first part, thereby interconnecting the two parts.

2. A plate as claimed in claim 1, wherein the interconnecting portion is formed by at least one return portion extending from a lip defining said second opening.

3. A plate as claimed in claim 2, wherein the projecting portion is substantially frusto-conical and the second part is domed to provide a recess for receipt of the projecting portion, the return portion or portions capturing the projecting portion in the recess by being swaged toward the internal surface of the projecting portion.

4. A plate for use with a rock bolt to support a mine roof, said plate comprising:

a first part having an inner surface for abutment with a rock face, an outer surface, and a projecting portion having an edge defining a first opening for the rock bolt; and a second part for transferring load from said first part to the rock bolt, said second part being in contact with the outer surface of said first part, at least a portion of said second part conforming substantially to said projecting portion, said second part further comprising a return portion extending through said first opening so as to form a groove into which said edge is received.

5. A plate as claimed in claim 4, wherein said projecting portion is substantially frusto-conical and at least part of said return portion forming said groove is swagged around said edge towards the inner surface of said first part to thereby interconnect said first and second parts.

* * * * *